United States Patent [19]

Snider et al.

[11] Patent Number: 4,516,897

[45] Date of Patent: May 14, 1985

[54] CANTILEVER PADDLE FOR USE WITH WAFER BOATS

[75] Inventors: Wendall L. Snider; Edward A. Wagner, both of Alamo, Calif.

[73] Assignee: Berkeley Glasslab, Pleasanton, Calif.

[21] Appl. No.: 496,835

[22] Filed: May 23, 1983

[51] Int. Cl.[3] ..... F27D 5/00; B27B 9/14

[52] U.S. Cl. ..... 414/180; 432/239; 432/242; 432/253

[58] Field of Search ..... 414/147, 160, 180, 181, 414/183, 586, 152, 156, 182, 184–186; 432/239, 242, 253

[56] References Cited

U.S. PATENT DOCUMENTS

| | | | |
|---|---|---|---|
| 646,475 | 4/1900 | Swanger | 414/182 |
| 2,409,284 | 10/1946 | Jackson | 432/242 X |
| 2,501,768 | 3/1950 | Fones | 414/185 |
| 3,744,650 | 7/1973 | Henebry et al. | 432/239 X |
| 3,811,825 | 5/1974 | Enderlein | 432/253 X |
| 4,412,812 | 11/1983 | Sadowski et al. | 432/253 X |

*Primary Examiner*—Robert G. Sheridan
*Assistant Examiner*—David A. Bucci
*Attorney, Agent, or Firm*—Thomas E. Schatzel

[57] ABSTRACT

A cantilever wafer paddle system for use in the manufacture of semiconductor devices so the system having two support members positioned above and attached to a suspension member such that the suspension member is capable of supporting and suspending a series of wafer boats within a diffusion tube without allowing any portion of the paddle, boats or wafers contained within the boats to contact the internal walls of the diffusion tube.

18 Claims, 9 Drawing Figures

CANTILEVER PADDLE FOR USE WITH WAFER BOATS

BACKGROUND OF THE INVENTION

1. Field of the Invention

The present invention relates to wafer carrier systems used in the semiconductor industry and more particularly, to suspended cantilever paddle systems.

2. Description of the Prior Art

In the manufacture of silicon and other types of wafers used in semiconductor industries, wafers are subjected to relative high temperatures for specific periods of time. Wafer fabrication furnaces are used to generate the necessary heat. The wafers are placed within the furnaces in boats or wafer carriers which are supported and suspended within the furnace by boat suspension systems or paddles.

At present, there are two types of paddles used in the semiconductor industry, a wheelbarrow design and a totally suspended cantilever design. The present invention relates more to the cantilever than the wheelbarrow paddle.

As new means are developed to increase the amount of electronic circuits on a silicon "chip" the purity of the silicon wafer, the base or platform of the "chip", becomes critical. If wafer impurities are not kept at acceptable tolerances, contaminated wafers must be rejected and destroyed resulting in high wafer fabrication costs. Only through strict purity control can wafer impurities be kept to a minimum and wafer yields optimized.

To reduce the impurities in wafer manufacture, particulate generation must be maintained at the lowest levels possible. The cantilever paddle design, unlike the wheelbarrow design, reduces particulate generation in the fabrication of silicon wafers. To reduce particulate generation, the cantilever paddle design eliminates all contact between the paddle, the boat or the wafers themselves with the interior walls of the diffusion tube. This elimination of contact between the wafer carrier system and the diffusion tube is accomplished by supporting the paddle at only one end of the system.

Conventional cantilever design utilizes two sleeved support members to suspend and support the paddle within the diffusion tube. The support members incorporate materials such as silicon carbide, aluminum oxide and quartz. The combined use of these materials is necessary to achieve the required structural rigidity in the support section of the paddle to minimize deflection of the paddle at its unsupported end. In some applications, the unsupported end of the paddle can extend over sixty inches in length.

Temperatures within the fabrication furnace have conventionally ranged from 600° C. to 900° C. More recently, due to advances in electrical circuit design, furnace temperatures have increased to between 900° C. and 1300° C.

While conventional paddle design is adequate for some wafer manufacture, it has serious drawbacks. One such disadvantage of a conventional cantilever paddle design relates to high particulate generation, especially in high temperature fabrication, due to outgasing by the conventional composite support members.

Another disadvantage of the conventional cantilever paddle design concerns the insufficient structural support provided by the conventional support and suspension members over the length of the paddle. The insufficient support results in paddle deflection at the unsupported end of the paddle causing improper positioning of the wafers within the furnace, thereby decreasing wafer yield, and in extreme cases, resulting in contact between the paddle and the furnace wall. As discussed above, such contact between the paddle and the furnace wall percipitates undesired and detrimental particulate generation that the cantilever paddle design is utilized to avoid.

A further disadvantage of the conventional cantilever paddle design concerns how difficult it is to clean. The difficulty is due to the design of the paddle which integrates the support and suspension members of the paddle into one unified structure. In this configuration, total disassembly of the paddle must be accomplished before the suspension members of the paddle can be disengaged from the system for cleaning resulting in lost production time.

Another disadvantage of the conventional cantilever design concerns its inability to easily accept different wafer boat configurations due to the integral design of its support and suspension members resulting in less efficient wafer manufacture.

SUMMARY OF THE PRESENT INVENTION

It is therefore an object of the present invention to provide an improved cantilever paddle which eliminates particulate generation due to the use of composite material support/suspension members.

It is another object of the present invention to provide an improved cantilever paddle with increased structural support to reduce paddle deflection and associated particulate generation within the furnace.

It is a further object of the present invention to provide an improved cantilever paddle that is easy to clean and requires less non-operational time than the conventional cantilever paddle design.

It is another object of the present invention to provide an improved cantilever paddle that can be easily adapted to function with all wafer boats.

Briefly, a preferred embodiment of the present invention includes use of a multi-tiered cantilever paddle. In the multi-tiered design, the support members are made of pure quartz and extend out from a paddle drive, designed to move the paddle in and out of the fabrication furnace, as short cylindrical tubes. Positioned under the support members are a set of suspension members designed to suspend and support the wafer boats within the furnace. The suspension members are, as with the support members, fabricated from a single refractory material such as quartz or in high temperature application, artifically grown sapphire. The suspension members are connected to and positioned about the support members by at least two support braces. These braces are also fabricated from a single refractory material and include a series of holes cut at predetermined locations on the brace. The holes are large enough for the suspension and the support members to pass through. The braces are positioned at predetermined locations on the suspension and support members to provide maximum structural rigidity for the system. Such rigidity is found in the new systems distribution of the suspension member's load over the length of the support members. Behind the last brace located closest to the paddle drive device is a heat shield or door designed to close off the furnace when the paddle is in its operational position. The suspension members do not extend into this door. Located on the suspension members and positioned just behind the last support brace closest to the door is at least one retainer pin designed to prevent unintentional removal of the suspension members from the support braces. These pins are designed to be easily removed so as to allow suspension members to be disengaged from the support braces for easy and economical cleaning. The support members are extremely short in comparison to the suspension members usually extending only six inches into the furnace. The suspension members, on the other hand, are comparitively quite long, sometimes extending out to sixty inches in length. Positioned between the suspension members, from the end of the support members to the opposite end of the suspension members, are a series of alignment braces through which the suspension members pass. These alignment braces maintain a predetermined relationship between the suspension members. The suspension and support members are securely affixed to the support braces either by fasteners or by phyiscal bonding.

An advantage of the present invention is that it eliminates particulate generation due to composite material outgasing from conventional support/suspension members as the improved cantilever design more uniformly distributes the load forces of the suspension members of the paddle over the support members thereby allowing use of single refractory material support members heretofore unavailable in conventional cantilever paddles due to the structural design.

Another advantage of the present invention is that it increases structural rigidity of the paddle thereby reducing deflection over the length of the paddle.

Another advantage of the present invention is that it provides an easy, quick and economical means by which to detach the support members from the support braces for cleaning.

Another advantage of the present invention is that by isolating the support members from the suspension members, the suspension members can easily be adapted to carry any wafer design without effecting the structural characteristics of the support members.

These and other objects and advantages of the present invention will no doubt become obvious to those of ordinary skill in the art after having read the following detailed description of preferred embodiments which are illustrated in the various drawing figures.

IN THE DRAWING

DETAILED DESCRIPTION OF THE PREFERRED EMBODIMENT

Figure 1:
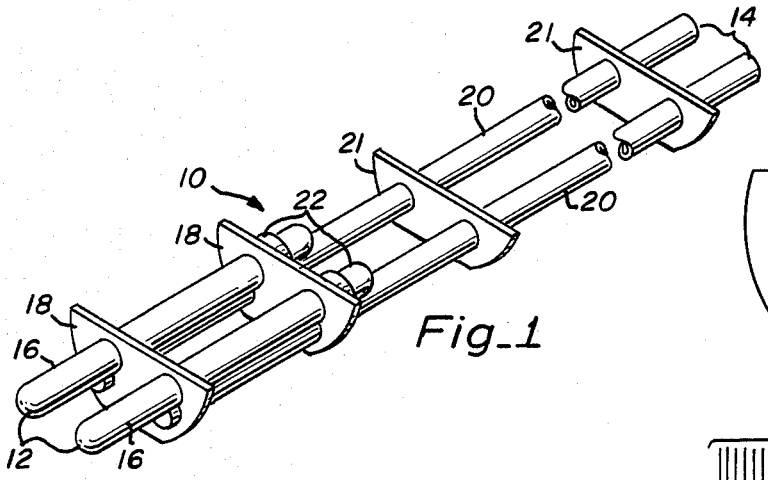
FIG. 1 illustrates a perspective view of a cantilever paddle according to the present invention.

Referring to FIGS. 1–4, there is shown a cantilever paddle of the present invention and referred to by general reference character 10. Paddle 10 has a load end 12, a source end 14, two support members 16, two support braces 18, two suspension members 20, a plurality of alignment braces 21, two permanent retainer rings 22, and two removable retainer pins 24. The support members 16 are substantially shorter than suspension members 20. Both support and suspension members 16 and 20 are of a tube design manufactured from a single refractory material such as quartz or artificially grown sapphire. Support members are secured at their load ends by a paddle drive device (discussed hereinafter, see FIG. 5) designed to move the paddle into and out of the fabrication furnace. The unsecured ends of the support members 16 extend outward from the drive toward the furnace. Positioned below the support members 16 are suspension members 20. Suspension members 20 are of considerable length and in certain applications extend up to sixty inches in length. Suspension members 20 are secured to and aligned with support members via support braces 18. Support braces 18 are designed with holes in predetermined locations through which support members 16 and suspension members 20 may pass. The support members 16 are prevented from moving out of support brace 18 via permanent retainer rings 22. Suspension members 20 can be freely inserted or removed from support braces 18. Removable retainer pin 24 is designed to prevent unintentional dislocation of suspension members 20 from support brace 18. Retainer pin 24 is also designed to be easily removable to facilitate quick disassembly of suspension members 20 from support braces 18. To maintain a uniform alignment along the length of suspension members 20, alignment braces 21 are employed. Alignment braces 21 are composed of single refractory material and have at least two holes through which the suspension members 20 may pass. The holes in braces 21 are located at predetermined positions. Braces 21 are securely affixed to suspension members 20 via fasteners or physical bonding.

Figure 3:
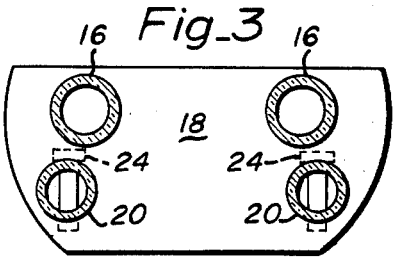
FIG. 3 illustrates a cross sectional view of the cantilever paddle of FIG. 2, taken along line 3—3 of FIG. 2.
Figure 2:
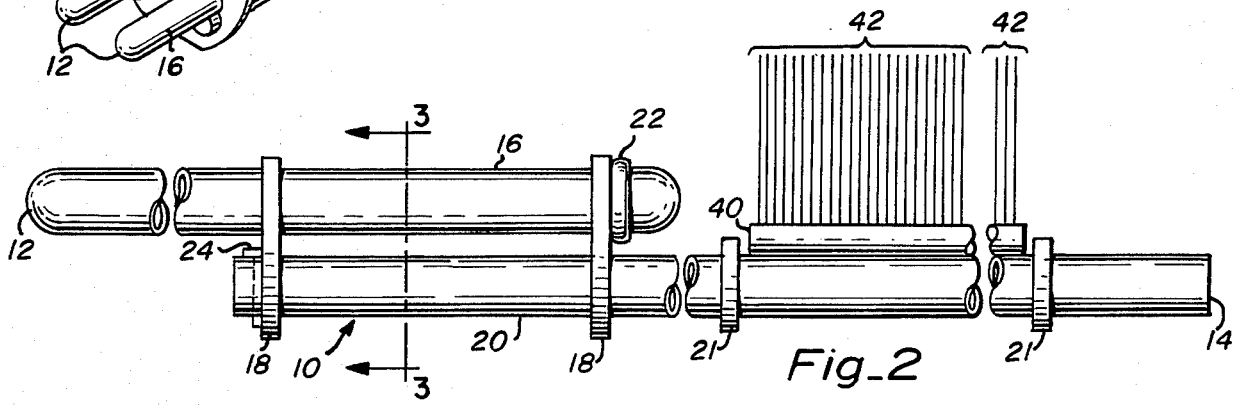
FIG. 2 illustrates a side view of the cantilever paddle of FIG. 1 supporting a full wafer boat.
Figure 4:
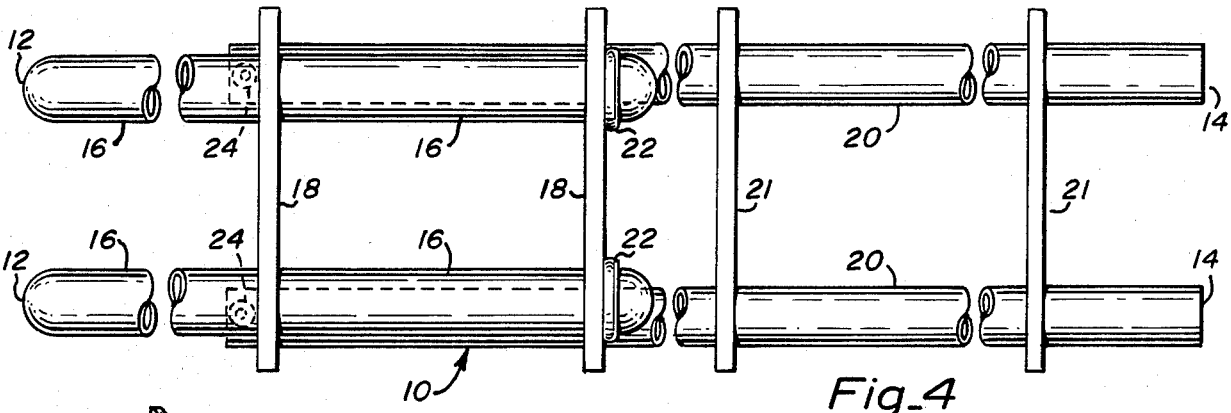
FIG. 4 illustrates a top view of the cantilever paddle of FIG. 1.

Referring to FIG. 2 there is shown a side view of paddle 10 with a wafer boat 40 suspended on and supported by paddle 10. Being supported by wafer boat 40 are a multiplicity of silicon wafers 42. FIG. 3 illustrates a cross-sectional view of paddle 10 taken along line 3-3 of FIG. 2 and FIG. 4 illustrates a top view of paddle 10.

Figure 5:
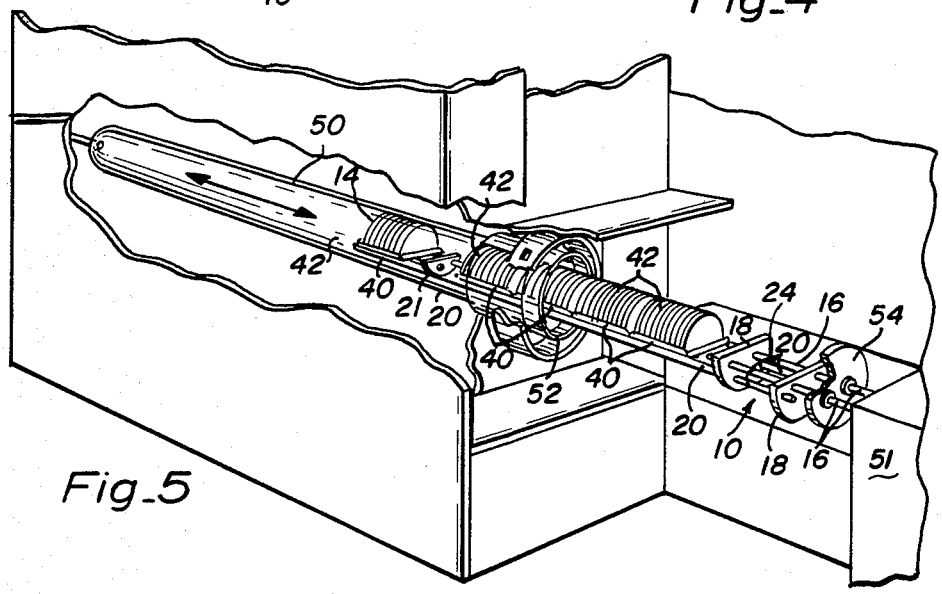
FIG. 5 illustrates a cut-away perspective view of the cantilever paddle of FIG. 1 partially inserted into a wafer fabrication furnace.

Referring to FIG. 5 there is shown a cut-away perspective view of paddle 10 partially inserted in a fabrication furnace 50. In operation, paddle 10 is loaded with wafer boats 40 which themselves are fully loaded with silicon wafers 42. The full paddle 10 is then inserted into furnace 50. The source end 14 of paddle 10 enters furnace 50 first and the load end 12 remains secured to a paddle drive device 51 and never enters furnace 50. A paddle door 52 tightly seals furnace opening 54 when paddle 10 is fully inserted in furnace 50. Paddle 10 is moved in and out of furnace 50 via paddle drive device 51. In practice, support members 16 are affixedly attached to drive 51 preventing any slippage between paddle 10 and drive 51. Under no condition is any portion of paddle 10, wafer boat 40 or wafers 42 allowed to contact the interior walls of furnace 50.

The advantages of the present invention should be evident. Use of the multilevel suspension systems provides a multipoint load distribution design. The multipoint load distribution design allows the full load of suspension members 20 to be distributed over the greater portion of support members 16 via support braces 18. For this reason, support members 16 may be fabricated from lower strength materials than conventional support/suspension members. The preferred material for support members 16 is a single refractory material such as quartz or artificially grown sapphire. These substances are capable of withstanding high temperatures without loss of structural integrity. This type of single refractory material is also the preferred substance for manufacture of suspension members 20 support braces 19 and alignment braces 21. In the case of quartz, temperatures up to 1050° C. can be withstood before any plastic deformation or deformity transpires. In the case of artificially grown sapphire, temperatures up to 2000° C. can be withstood before deformation occurs. The advantages of the use of these substances are two-fold. In wafer fabrication, these substances do not generate outgasing or particulate matter, thereby maintaining a more impurity free environment for wafer fabrication than the conventional design. As discussed, such an environment is critical in today's wafer manufacture. The second advantage to the use of pure quartz or sapphire for support members 16 is realized in high temperature wafer manufacture. When temperatures of over 1100° C. are utilized, conventional support members lose their structural integrity, resulting in paddle deflection and particulate matter contamination. Use of the pure quartz or sapphire support members 16 allow the present invention to avoid this problem. It should be noted that when temperatures in the fabrication furnace 50 are discussed, such temperatures are measured in the "hot zone" of the furnace 50 which is located in the middle portion of furnace 50. The temperatures at load end 12 of paddle 10, which effects support members 16, are usually not as high as those in the "hot zone". For this reason, pure quartz members can be utilized even without hot zone temperatures over 1100° C.

Another advantage of the present invention is that any number of support members 16 may be utilized to stabilize suspension members 20 within furnace 50 without increasing the weight of suspension members 20. In the conventional design, a single suspension/support member must serve both support and suspension functions. Therefore, strengthening of the conventional support member, either by increasing the diameter of said support member or the number of these members, results in a corresponding increase in weight over the suspension portion of the member increasing the load forces on the support members, thus, allowing only marginal increases in structural stability even with dramatic increases in the size or number of the support/suspension members. Alternatively, any strengthening of the suspension members 20 to prevent sagging or deflection of paddle 10 within the conventional paddle design, would produce an increase in the size or number of the support members whether or not such was desirable in the support design. In the present invention, structural rigidity of suspension members 20 may be increased by use of a greater number of thicker or thinner members 20 or by changing the shape or configuration of suspension members 20, without affecting the support characteristics of support member 16. Due to this ability to change the structural characteristics of members 20 independently of suspension member 16, paddle 10 can be easily designed to accept any known type of boat configuration. Such an ability to adapt paddle 10 to different boat designs is not inherent in the conventional paddle.

Also, the use of the present design enables simple dismantling of paddle 10 for cleaning. Support members 16 do not have to be removed to clean suspension members 20 due to the location of retaining pin 24 on the source side of door 50 in suspension members 20. In the conventional design, due to the integration of the support and suspension members, cleaning of suspension members requires the time consuming task of totally dismantling the paddle from the paddle drive 20.

Figure 6:
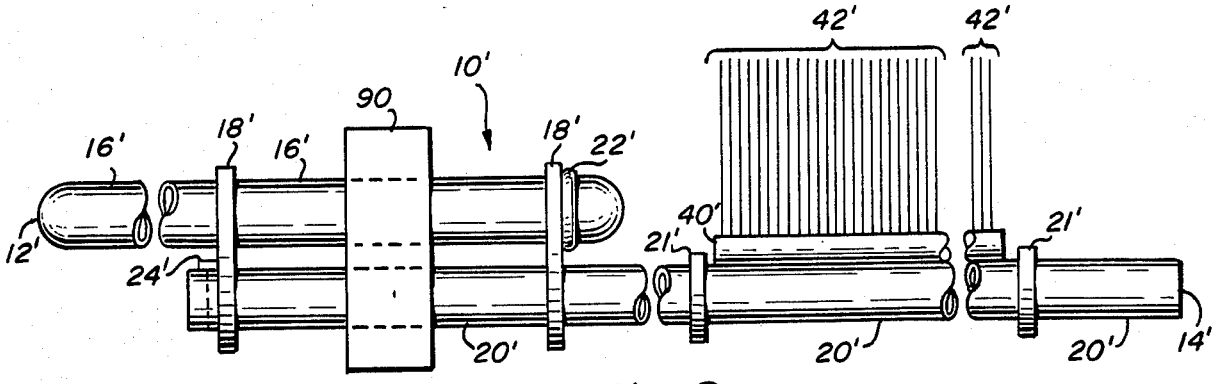
FIG. 6 illustrates a front view of an alternative embodiment of a cantilever paddle according to the present invention utilizing an end plug.

In an alternative embodiment, as illustrated in FIG. 6, a heat sink plug 90 may be added to paddle 10. Components of FIG. 6 that are the same as those in FIG. 1–5 carry the same reference number distinguished by a prime designation. The heat sink plug 90 is designed to reduce heat loss within the furnace system and is located on the source side of door 54 on support member 16. The heat sink plug 90 is generally located at a position away from the ends of support members 16'. However, it may be located about the ends in the form of a condensor end cap. The choice of either a heat sink plug or a condensor end cap is dictated by the specific design of the furnace. The plug or condensor end cap are both designed to fit about the support member 16' and the suspension members 20' without restricting the quick and easy removal of suspension members 20' from support braces 18'.

Figure 8:
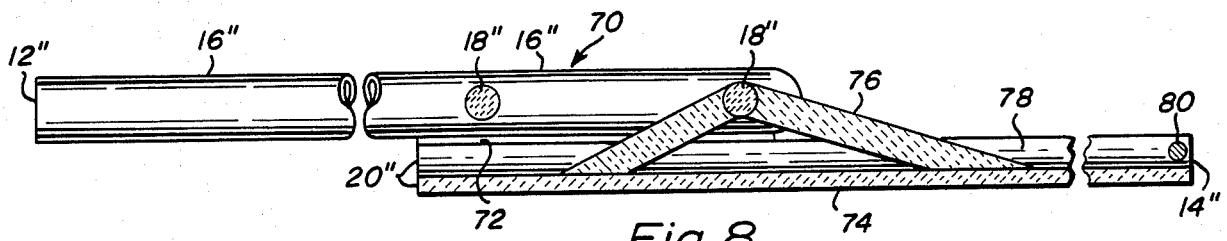
FIG. 8 illustrates a cross-sectional view of the cantilever paddle of FIG. 7 taken along line 7—7 of FIG. 7.
Figure 7:
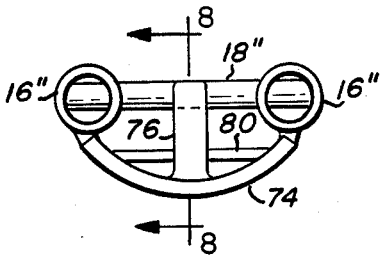
FIG. 7 illustrates a front view of an alternative embodiment of a cantilever paddle according to the present invention.
Figure 9:
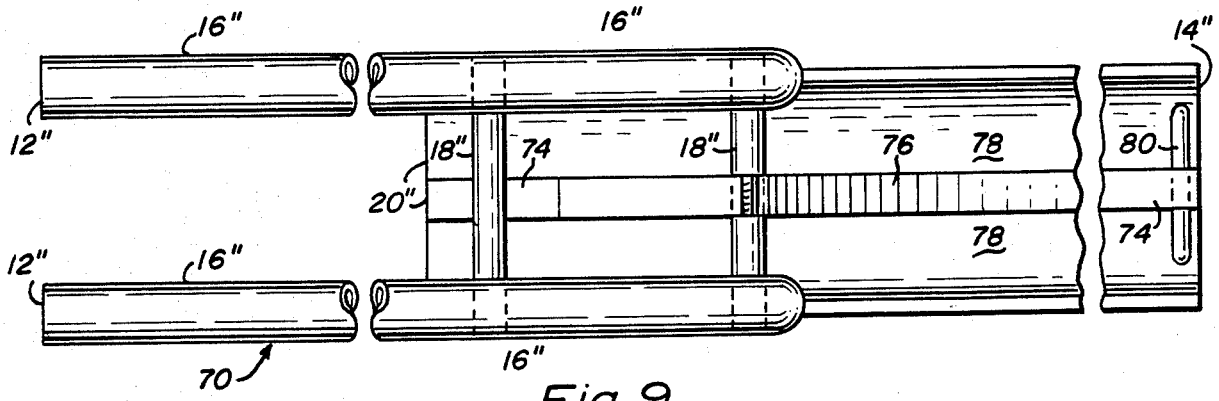
FIG. 9 illustrates a top elevational view of the cantilever paddle of FIG. 7.

A further alternative embodiment of the present invention is illustrated in FIGS. 7–9 and referred to by the general reference character 70. Components of the paddle 70 of FIGS. 7–9 that are similar to components of FIGS. 1–5 carry the same reference number distinguished by a double prime designation. The paddle 70 has two support members 16'' separated by support braces 18''. Positioned under support members 16'' is the suspension member 20''. Suspension member 20'' is fixedly mounted to support members 16'' by means of physical bonding 72. Suspension member 20'' is composed of a support arm 74, a support arm brace 76 and a curved shell 78. In practice, the curved shell 78 is designed to conform to the desired wafer boat configuration (not shown). The curved shaped of shell 78 provides rigidity to the suspension member 20''. Support arm 74 extends the length of the curved shell 78 and adds additional structural rigidity to the suspension member 20. Support arm 74 is attached to support brace 18'' via support arm brace 76. Support arm brace 76 is physically bonded to support arm 74 and support brace 18''. Located at the source end 14'' of paddle 70 is an end pin 80 designed to prevent wafer boats (not shown) from extending past the end of suspension member 20''. All of the aforementioned components of paddle 70 are fabricated from a single refractory material, preferably quartz or artificially grown sapphire.

Paddle 70 has been designed more for use in low temperature, below 900° C., wafer fabrication due to the fact that curved shell 78 is, at the present time, difficult to fabricate out of grown sapphire. But, paddle 10, as shown in FIGS. 1–5, is specifically designed for use in high temperature, 900° C. to 1300° C., fabrication furnaces as the design lends itself to use of artificially grown sapphire for any and all of the elements of paddle 10.

While for the sake of clearness and in order to disclose the invention so that the same can be readily understood, a specific embodiment has been described and illustrated. It is to be understood that the present invention is not limited to the specific means disclosed. It may be embodied in other ways that will suggest themselves to persons skilled in the art. It is believed that this invention is new and that all changes that come within the scope of the following claims are to be considered as part of this invention.

We claim:

1. A cantilever paddle for supporting and suspending wafer boats within a wafer fabrication furnace with loaded wafers, and paddle spaced from the interior walls of said furnace and comprising:

a first support means supported by and mounting in a wafer paddle drive device, the support means being fabricated from a single refractory material; and a suspension means for supporting and positioning said wafer boats in suspension within said furnace, the suspension means being positioned below the support means, and including at least one alignment brace, said alignment brace having portions defining at least one aperture through which said suspension means may pass through, and the suspension means being completely located within said furnace when said panel is in its operational position.

2. A cantilevered paddle according to claim 1 wherein, the suspension means is supported by the support means by a plurality of support braces and the suspension means are detachably attached to the support braces.

3. A cantilever paddle according to claim 2 wherein, the support means is shorter than the suspension means, and the support means is fixedly attached to the support braces.

4. A cantilever paddle according to claim 3 wherein, the support means is a plurality of cylindrical, single refractory material support tubes designed to pass through a heat sink plug positioned about the support means.

5. A cantilever paddle for supporting and suspending wafer boats within a wafer fabrication furnace with loaded wafers and paddle spaced from the interior walls of said furnace and comprising:

a first support means supported by and mounted in a wafer paddle drive device, the support means being fabricated from a single refractory material; and a suspension means for supporting and positioning said wafer boats in suspension within said furnace, the suspension means being positioned below the support means and completely located within said furnace when said paddle is in its operational position, the suspension means including a plurality of cylindrical single refractory suspension tubes aligned about themselves by a plurality of alignment braces, and said alignment braces having portions defining a plurality of holes through which said suspension tubes are designed to pass.

6. A cantilever paddle for supporting and suspending wafer boats within a wafer fabrication furnace with loaded wafers and paddle spaced from the interior walls of said furnace and comprising:

a first support means supported by and mounted in a wafer paddle drive device, the support means includes a plurality of cylindrical single refractory material support tubes, the support means being fabricated from a single refractory material; and a suspension means for supporting and positioning said wafer boats in suspension within said furnace, the suspension means being positioned below the support means and completely located within said furnace when said paddle is in its operational position, the suspension means including a plurality of cylindrical refractory material suspension tubes, the support and suspension means being fixedly mounted together via a plurality of support braces having a plurality of apertures through which said support and suspension tubes are passed, said suspension tubes having at least one retaining fastener to prevent said suspension tubes from passing through said support tubes when said suspension tubes are in their operational position within said furnace, said retaining fastener being removable from said suspension tubes so that said suspension tubes may be detached from said support braces for cleaning, said support tubes incorporating a heat sink plug to prevent heat from escaping from said furnace while said paddle is within said furnace, said heat sink plug being located about said support and suspension tubes to allow said suspension tubes to be detached from said support braces, said suspension tubes being aligned about themselves by a plurality of alignment braces, said alignment braces having portions defining a plurality of holes through which said suspension tubes pass and said suspension tubes are fixedly attached to said alignment braces.

7. A cantilever paddle for supporting and suspending wafer boats within a wafer fabrication furnace with loaded wafers and paddle spaced from the interior walls of said furnace and comprising:

a first support means supported by and mounted in a wafer paddle drive device, the support means including a plurality of cylindrical single refractory material support tubes aligned about themselves by a plurality of support braces, and the support means being fabricated from a single refractory material; and a suspension means for supporting and positioning said wafer boats in suspension within said furnace, the suspension means being positioned below the support means and completely located within said furnace when said paddle is in its operational position, the suspension means incorporating at least one concave curved support shell transversing the length of said furnace with the upper most edges of said shell fixedly attached to said support tubes, said suspension means further incorporating a suspension support arm to structurally reinforce said shell and fixedly attached to said curved shell, said suspension support arm being fixedly attached to a suspension support arm brace fixedly attached to at least one support brace, and located at the end of said shell furthest away from said support tubes is an interminable pin designed to limit the degree of movement of said wafers on the suspension means.

8. A cantilever paddle for use at temperatures above 900° C. for supporting and suspending a plurality of silicon wafer boats within a wafer diffusion furnace with loaded wafers and paddle spaced from the interior wall of said furnace and comprising:

a plurality of support tubes;

a plurality of suspension tubes located below and supported by said support tubes by a plurality of support braces, the suspension tubes being designed to physically support and suspend wafer boats within a furnace, said support braces having portions defining a plurality of holes positioned at predetermined locations in said support brace, the support and suspension tubes being capable of passing through said support brace holes, the suspension tubes being of a predetermined length to transverse the overall length of said furnace, and the support tubes are shorter than the suspension tubes.

9. A cantilever paddle according to claim 8 wherein, the support tubes are fixedly attached to said support braces, the suspension tubes are detachably mounted in said support braces by at least one retainer fastener, whereby the support tubes may be removed from said support braces for cleaning said support braces while said paddle is within said furnace.

10. A cantilever paddle according to claim 9 wherein, the suspension tubes are aligned about themselves by a plurality of alignment braces, said alignment braces having portions defining holes positioned at predetermined locations in said alignment braces, the suspension tubes being capable of passing through said alignment holes, and the suspension tubes are fixedly attached to said alignment braces.

11. A cantilever paddle according to claim 8 wherein, the support tubes are composed of a single refractory material and the suspension tubes are composed of a single refractory material.

12. A cantilever paddle according to claim 10 wherein, the support tubes are quartz, the suspension tubes are artificially grown sapphire, said support braces are quartz and said alignment braces are quartz.

13. A cantilever paddle according to claim 10 wherein, said support braces are a single refractory material and said alignment braces are a single refractory material.

14. A cantilever paddle according to claim 12 wherein, the support tubes are quartz and the suspension tubes are artificially grown sapphire.

15. A cantilever paddle for use at temperatures below 900° C. in silicon wafer fabrication for supporting and suspensing a plurality of wafer boats within a wafer diffusion furnace with said wafers and paddle spaced from the interior wall of said furnace and comprising:

a plurality of cylindrical support tubes;

a concave curved shell located below and supported by the support tubes, the shell being of a predetermined length to transverse the length of a furnace;

a support arm fixedly mounted on the curved shell and transversing the length of the shell;

a plurality of support braces fixedly attached to the support tubes and designed to maintain a predetermined distance between the support tubes; and a support arm brace fixedly mounted on the support arm and detachably attached to at least one of the support braces to allow removal of the curved shell, the support arm physically supporting and suspending wafer boats within said furnace.

16. A cantilever paddle according to claim 15 wherein, the curved shell is fixedly attached to the support tubes and, the support arm brace is fixedly attached to at least one of the support braces.

17. A cantilever paddle according to claim 15 wherein, the support tubes are a single refractory material, the curved shell is a single refractory material, the support braces are a single refractory material, the support arm is a single refractory material, and the support arm brace is a single refractory material.

18. A cantilever paddle according to claim 17 wherein, said single refractory material is quartz.

* * * * *